US006756746B2

(12) United States Patent
Nerone et al.

(10) Patent No.: US 6,756,746 B2
(45) Date of Patent: Jun. 29, 2004

(54) METHOD OF DELAYING AND SEQUENCING THE STARTING OF INVERTERS THAT BALLAST LAMPS

(75) Inventors: Louis R. Nerone, Brecksville, OH (US); David J. Kachmarik, Strongsville, OH (US); Melvin C. Cosby, Jr., Grand River, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/247,796

(22) Filed: Sep. 19, 2002

(65) Prior Publication Data

US 2003/0094907 A1 May 22, 2003

Related U.S. Application Data

(60) Provisional application No. 60/323,448, filed on Sep. 19, 2001.

(51) Int. Cl.[7] ..... G05F 1/00

(52) U.S. Cl. ..... 315/291; 315/209 R; 315/360; 315/312

(58) Field of Search ..... 315/225, 291, 315/209 R, 312, 360, DIG. 5, 307, 200 R, 224, 246, 247, 274, 276, 277, 324

(56) References Cited

U.S. PATENT DOCUMENTS 5,177,408 A 1/1993 Marques ..... 315/291
5,408,403 A * 4/1995 Nerone et al. ..... 363/37
5,945,783 A * 8/1999 Schultz et al. ..... 315/219
6,111,363 A * 8/2000 Nerone ..... 315/225
6,175,198 B1 1/2001 Nerone ..... 315/291
6,392,365 B1 * 5/2002 Zhou et al. ..... 315/291
6,437,520 B1 * 8/2002 Grouev et al. ..... 315/291

* cited by examiner

*Primary Examiner*—Tuyet T. Vo
(74) *Attorney, Agent, or Firm*—Fay, Sharpe, Fagan, Minnich & McKee, LLP

(57) ABSTRACT

An inverter circuit for ballasting a gas discharge lamp having a delay circuit designed to delay regenerative control of the inverter switches until a d.c. bus has attained steady-state operating d.c. voltage. The inverter circuit includes a drive control circuit for inducing an a.c. load current. The inverter circuit includes first and second complementary switches serially connected between the bus and a reference bus. The switches are connected together at a common node through which the a.c. load current flows. A driving inductor is connected at one end to the common node and operatively connected at the remaining end to a control node. A load circuit includes a resonant inductor connected at one end to the common node, with the resonant inductor mutually coupled to the driving inductor. A resonant capacitor is serially connected between the remaining end of the resonant inductor and the reference bus. The gas discharge lamp is serially connected with a d.c. blocking capacitor across the resonant capacitor. A delay circuit, comprising a serially connected resistor and capacitor is connected across the drive control circuit.

38 Claims, 2 Drawing Sheets

METHOD OF DELAYING AND SEQUENCING THE STARTING OF INVERTERS THAT BALLAST LAMPS

This application claims the benefit of provisional application No. 60/323/448, filed Sep. 19, 2001.

BACKGROUND OF INVENTION

In the past, there have been a number of efforts to improve the performance of ballasts for gas discharge lamps. One direction such efforts have taken is to utilize electronic ballasts of the type having an input section for power factor and harmonic correction and an output section operating as a current-fed power resonant inverter. Active preregulator circuits have been used in an attempt to obtain high power factor and harmonic correction in such input sections. At the same time, the instant-start type of gas discharge lamps continue to be extremely popular, calling for ballasts which are compatible with instant-start lamps.

The use of active preregulators in instant-start applications has led to startup problems in that the integrated circuits used in such active preregulators take appreciable time to attain steady state operating conditions during start-up and can present undesirable operating conditions to the gas discharge lamps when passed through the inverter section during start-up transient conditions. For example, one integrated circuit useful in active preregulators typically takes 100 milliseconds up to 500 or 1,000 milliseconds to reach steady state operating conditions. At steady state conditions, the active preregulator provides 170 volts DC output, however, during transient start-up conditions the output is substantially below that. When operating instant-start lamps, this results in the undesirable effect of an unacceptably long "preheat" or glow period at low voltage. For instant-start lamps, it is desirable to attain 90% of the steady-state operating voltage in less than 100 milliseconds, because longer preheat periods undesirably shorten lamp life due to excessive electrode erosion during such low-voltage preheat conditions. This is in addition to undesirable visible phenomena during starting. Solutions have been developed for the more expensive current-fed, power-resonant type of circuits, however, it is desirable to provide a simple, inexpensive solution for the less expensive voltage-fed type of circuit.

Additionally, the above-described problem of an unacceptably long preheat period is exacerbated by the use of voltage-fed circuits in place of current-fed circuits. It is, however, desirable to use voltage-fed circuits which are less expensive than current-fed circuits. The problem is exacerbated even more on multi-inverter systems where starting multiple lamps simultaneously may cause a dip in the supply bus voltage because the inverters draw a transient of current during lamp ignition, and, the cumulative effect of multiple transient currents temporarily overloads the voltage, source. It is, therefore, desirable to provide a simple, inexpensive solution to the harmful effects of multiple transient currents for the less expensive voltage-fed type of circuit.

BRIEF DESCRIPTION OF THE INVENTION

In an exemplary embodiment of the present invention, a voltage-fed type of inverter for ballasting gas discharge lamps is provided. The inverter includes a d.c. bus, a reference bus, serially connected first and second inverter switches, each having a control terminal, between the d.c. bus and the reference bus, a control node for interconnecting the control terminals of the switches, a common node comprising the interconnection of the switches, a drive control circuit serially connected between the control node and the common node for regenerative control of the switches, a resonant inductor serially connected to a load circuit between the common node and the reference bus, and a delay circuit connected between the control node and the common node. The delay circuit delays the drive control circuit from starting regenerative control of the inverter switches for a predetermined period of time, allowing the d.c. bus to attain full steady-state operating voltage before the inverter starts.

DETAILED DESCRIPTION OF THE INVENTION

Figure 1:
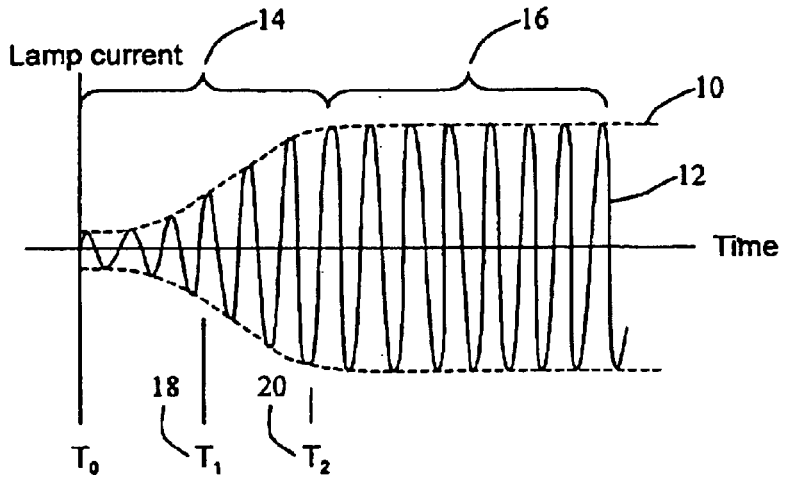
FIG. 1 shows an exemplary representation of lamp current during transient start-up time.

As shown in FIG. 1, amplitude 10 of lamp current 12 during transient start-up time 14 is substantially below the amplitude maintained during steady-state operation 16. When operating instant-start lamps, this results in the undesirable effect of an unacceptably long preheat or glow period at low voltage starting at time $T_1$ (18). By time $T_2$ (20), the lamp current has attained approximately 90% of its steady state value, ending the preheat period. Therefore, for instant-start lamps, it is desirable to attain 90% of the steady-state operating voltage in less than 100 milliseconds, because longer preheat periods undesirably shorten lamp life due to excessive electrode erosion during such low-voltage preheat conditions. For an electronic power resonant inverter of the voltage-fed type, this can be accomplished by delaying operation of the inverter section until the d.c. bus has achieved full steady-state operating voltage.

Figure 2:
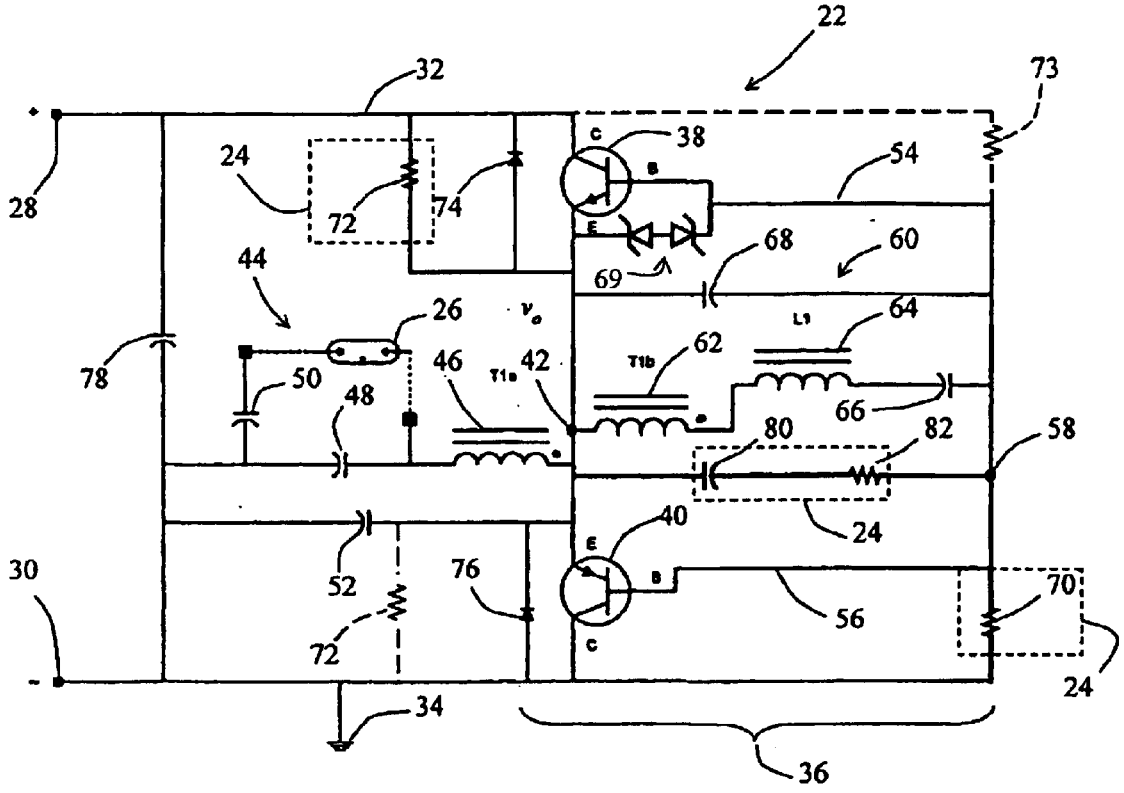
FIG. 2 is a circuit diagram of an inverter incorporating an embodiment of the present invention.

FIG. 2 shows an inverter circuit 22 for ballasting lamps incorporating a delay circuit 24 in accordance with one embodiment of the present invention. An instant start lamp 26 is powered from a d.c. bus voltage provided by a voltage source attached to bus terminal 28 and reference terminal 30. The d.c. bus voltage exists between a bus node 32 and a reference node 34. The lamp 26 receives power after such d.c. voltage is converted to a.c., by d.c.-to-a.c. inverter section 36.

Switches 38 and 40, serially connected between nodes 32 and 34, are used in the conversion process. When the switches comprise npn and pnp Bipolar Junction Transistors, respectively, the emitter electrodes of the switches are connected substantially directly together at a common node 42. The switches may comprise other devices having complementary conduction modes, such as, but not limited to, n-channel and p-channel enhancement mode MOSFETs. A resonant load circuit 44 includes a resonant inductor 46 and a resonant capacitor 48 for setting the frequency of resonant operation. Typically, circuit 44 includes a d.c. blocking capacitor 50 and a so-called snubber capacitor 52.

Switches 38 and 40 cooperate to provide a.c. current from common node 42 to resonant inductor 46. The control electrodes, or gates in the case of MOSFETs, 54 and 56 of the switches are substantially directly interconnected at a control node or conductor 58. Control drive circuitry, generally designated 60, is connected between control node 58 and common node 42, for implementing regenerative control of switches 38 and 40. Drive inductor 62 is mutually coupled to resonant inductor 46, to induce in inductor 62 a voltage proportional to the instantaneous rate of change of current in load circuit 44. A second inductor 64 is serially connected to inductor 62, between common node 42 and control node 58. In some applications, it may be desirable to use a further inductor (not shown) connected between the right-shown node of inductor 64 and common node 42. A capacitor 66 may be connected in the serial circuit of inductors 64 and 62, between node 42 and node 58, for purposes explained below.

A capacitor 68 is preferably provided between nodes 42 and 58 to predictably limit the rate of change of control voltage between such nodes. This beneficially assures, for instance, a dead time interval during switching of switches 38 and 40 wherein both switches are off between the times of either switch being turned on.

A bi-directional voltage clamp 69, such as back-to-back Zener diodes, is preferably connected between nodes 42 and 58 to provide over-voltage protection when MOSFETs are employed in place of BJT transistors for switches 38 and 40.

Starting resistor 70, connected between nodes 58 and 34, and starting resistor 72, connected between node 32 and 42, cooperate for starting regenerative operation of gate drive circuit 60. In the starting process, capacitor 66 is initially charged, upon energizing of bus node 32, via starting resistors 70 and 72. At this instant, the voltage across capacitor 66 is zero, and, during the starting process, serial-connected inductors 62 and 64 act essentially as a short circuit, due to the relatively long time constant for charging of capacitor 66. With starting resistors 70 and 72 being of equal value, for instance, the voltage on common node 42, upon initial bus energizing, is approximately one-half of the voltage on bus node 32. In this manner, capacitor 66 becomes increasingly charged, from left to right, until it reaches the threshold voltage of the base-to-emitter junction of lower switch 40 (e.g., 0.7 volts). At this point, the lower switch switches into its conduction mode, which then results in current being supplied by that switch to resonant load circuit 44. In turn, the resulting current in the resonant load circuit causes regenerative control of switches 38 and 40.

During steady state operation of inverter circuit 22, the voltage of common node 42 becomes approximately one-half of the voltage on bus node 32. The voltage at node 58 also becomes approximately one-half the voltage on bus node 32, so that capacitor 66 cannot again, during steady state operation, become charged so as to again create a starting pulse for turning on switch 40. During steady state operation, the capacitive reactance of capacitor 66 is much larger than the inductive reactance of gate driving inductor 62 and second inductor 64, so that capacitor 66 does not interfere with operation of those inductors.

A resistor (73 shown in dotted form) may optionally be placed between bus node 32 and node 58 either in addition to or in place of starting resistor 70. In this case, starting resistor 72 may be alternatively placed in shunt across switch 40 as shown in dotted form rather than across switch 38. The operation of the alternate circuit is similar to that described above with respect to resistor 72 shunting switch 38. However, initially, common node 42 assumes a lower potential than node 58, so that capacitor 66 becomes charged from right to left. This results in an increasingly positive voltage between node 58 and node 42, which is effective for turning on upper switch 38.

Reverse conducting diode 74 is placed between the emitter and collector terminals of switch 38, with the anode of diode 74 at node 42, and the cathode at node 32 as shown. Reverse conducting diode 76 is similarly placed between the collector and emitter terminals of switch 40, with the anode of diode 76 at node 34, and the cathode at node 42 as shown. When MOSFETs are employed in place of BJT transistors for switches 38 and 40, reverse conducting diodes 74 and 76 may be omitted.

Smoothing capacitor 78 is preferably supplied between terminals 28 and 30 to ensure adequate filtering of a d.c. voltage source connected to the terminals. Capacitor 78 may be omitted when an adequately filtered d.c. source is connected to terminals 28 and 30.

Delay circuit 24, in accordance with one embodiment of the present invention, includes resistors 70 and 72 in cooperation with serial-connected delay capacitor 80 and delay resistor 82 between common node 42 and control node 58. Delay circuit 24 operates in the following manner. Delay capacitor 80 is charged through resistors 72, 70 and 82. Resistors 72 and 70, being of much higher resistance than resistor 82, dominate the current that charges capacitor 80. Delay resistor 82 reduces the interaction of the delay circuit 24 with the normal base current drive. When capacitor 80 is charged to approximately 1 volt, the inverter 22 begins to oscillate. The time required to charge capacitor 80 is determined by the magnitude of current flowing through resistors 72, 70 and 82 and the capacitance value of capacitor 80. The time to charge capacitor 80 can be approximated by $$\tau \cong \frac{C_d \cdot V_{be}}{V_b} \cdot (R_1 + R_2 + R_3)$$

where $V_b$ is the inverter bus voltage on node 32, $V_{be}$ is the forward bias voltage of the pnp transistor 40, $C_d$ is the value of capacitor 80, and $R_1$, $R_2$ and $R_3$ correspond to the values of resistors 72, 70 and 82 respectively.

When resistor 73 is used in place of starting resistor 70, $R_2$ represents the value of resistor 73. However, when resistor 73 is included with starting resistor 70, it is to be appreciated that the above-described equation for time to charge must be modified to take the additional resistor 73 into account as is well known in the art.

By adjusting parameters in the above-described equation, designers have great flexibility in selecting particular time delays for starting inverter 22. In the exemplary embodiment provided below, delays of approximately 200 milliseconds were observed in lab tests.

Exemplary component values for the circuit of FIG. 2 are as follows for an instant-start gas discharge lamp 26 rated at 23 watts, with an a.c. source 90 voltage of 120 volts RMS:

Resonant inductor 46 . . . 3.6 milli-henries
Driving inductor 62 . . . 360 micro-henries
Turns ratio between 46 and 62 . . . 35:1
Inductor 64 . . . 330 micro-henries
Capacitor 48 . . . 1.5 nano-farads
Capacitor 50 . . . 47 nano-farads
Capacitor 52 . . . 120 pico-farads
Capacitor 66 . . . 33 nano-farads
Capacitor 68 . . . 4.7 nano-farads
Capacitor 78 . . . 0.22 micro-farads
Capacitor 80 . . . 1 micro-farad
Resistors 70, 72, 73 . . . 3.3 meg-ohms
Resistors 82 . . . 20 k ohms In addition, npn transistor 38 is sold under the designation 13003, and pnp transistor 40 under the designation 93003. Diodes 74 and 76 are sold under the designation 1N4004.

Figure 3:
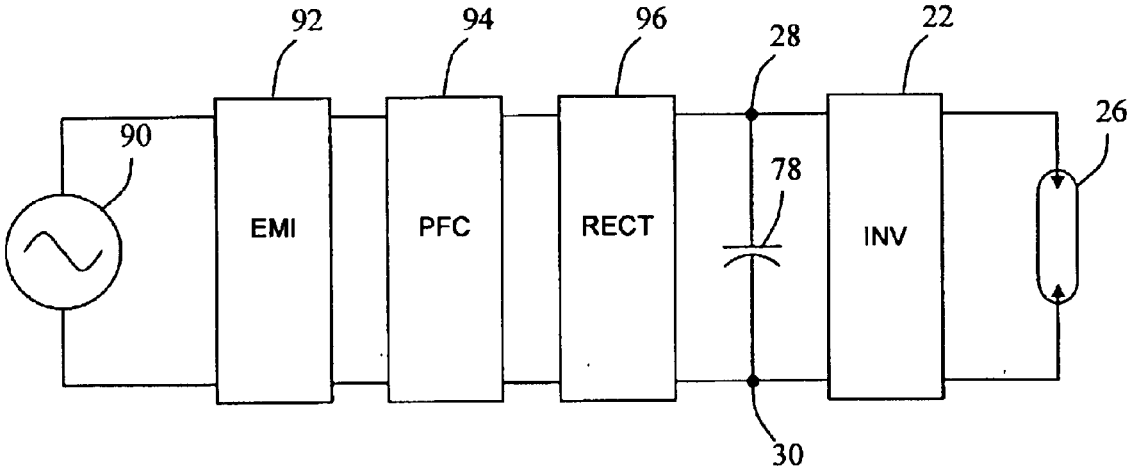
FIG. 3 illustrates a lamp and ballast single-inverter system incorporating an embodiment of the present invention.

An exemplary single-inverter system configuration incorporating inverter 22 for ballasting lamps is provided in FIG. 3. An a.c. voltage source 90 is connected to an electromagnetic interference (EMI) filter 92, which is in turn connected to a power factor controller (PFC) circuit 94, followed by a rectifier circuit 96, preferably a bridge diode rectifier, which is connected to terminals 28 and 30 of inverter 22 which is terminally connected to lamp 26. EMI filter 92, PFC component 94 and rectifier 96 are well known in the art to persons of average skill in the art and, therefore, are not described in detail herein.

Figure 4:
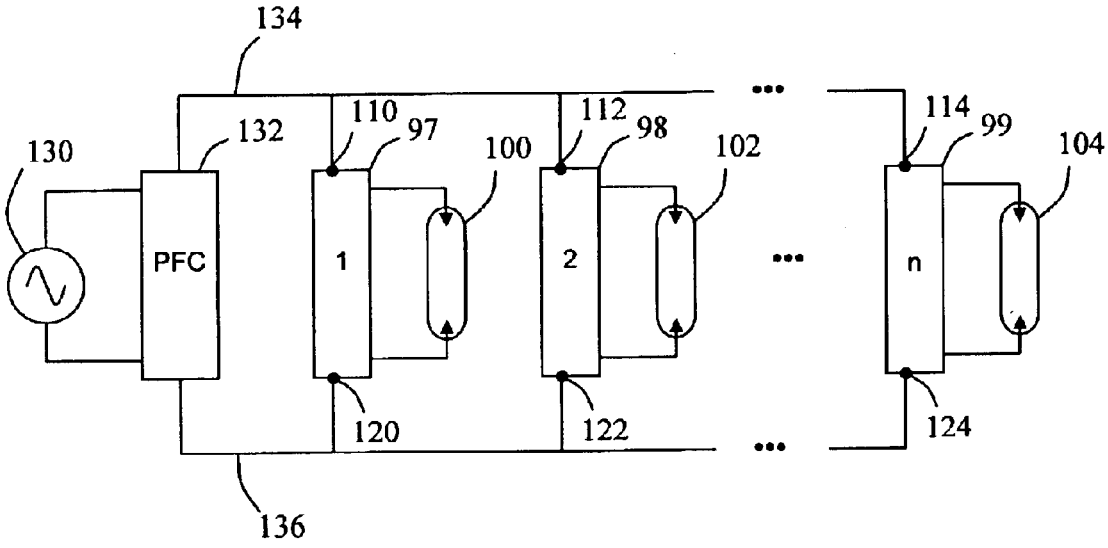
FIG. 4 illustrates a multi-inverter system incorporating an embodiment of the present invention.

The above-described flexibility in selecting particular time delays for starting an inverter can also be used to advantage in multi-inverter systems, allowing designers to select particular time delays for starting individual inverters in a multi-inverter system. For example, FIG. 4, with continuing reference to FIG. 2, shows an exemplary multi-inverter system comprising inverters 97, 98 and 99, designed in accordance with inverter 22 of FIG. 2, powering lamps 100, 102 and 104 respectively. Each inverter has a respective bus terminal 110, 112 and 114, and a respective reference terminal 120, 122 and 124. Although 3 inverter/lamp units are shown, it is to be understood that any number of units, from 1 to n, may be employed. The exemplary system of FIG. 4 also includes a voltage source 130 and a power factor controller (PFC) 132. PFC 132, as shown, includes an EMI filter to prevent electromagnetic interference from entering voltage source 130 and a rectifier circuit for providing a d.c. voltage on a bus conductor 134 with respect to a reference conductor 136. The rectifier circuit can be omitted from PFC 132 when each inverter circuit incorporates a rectifier circuit for rectifying an a.c. voltage on bus conductor 134. The inverters have their respective bus terminals connected to bus conductor 134, and have their respective reference terminals connected to reference conductor 136.

By varying values of one or more components in inverters 1 to n, particularly capacitor 80 and resistors 70, 72 and 82, the starting of inverter units can be sequentially delayed such that $\tau_1<\tau_2<\ldots<\tau_n$ where n is the number of units powered from a common bus 134. The ordering of inverters 22 on the common bus 134 is, of course, arbitrary.

While the invention has been described with respect to specific embodiments by way of illustration, many modifications and changes will occur to those skilled in the art. It is therefore, to be understood that the appended claims are intended to cover all such modifications and changes which fall within the true spirit and scope of the invention.

What is claimed is:

1. An inverter circuit for ballasting lamps comprising:

(a) a d.c. bus node;

(b) a reference node;

(c) an inverter having first and second switches, each having a control terminal, serially connected between said d.c. bus node and said reference node;

(d) a control node for interconnecting said control terminals of said first and second switches;

(e) a common node comprising the interconnection of said first and second switches;

(f) a drive control circuit serially connected between said control node and said common node for regenerative control of said first and second switches;

(g) a resonant inductor serially connected to a load circuit between said common node and said reference node; and (h) a starting delay circuit operatively connected to said control node and said common node for delaying oscillation of the inverter circuit for a predetermined period of time.

2. The inverter circuit of claim 1 wherein said delay circuit includes a delay capacitor and a delay resistor serially connected.

3. The inverter circuit of claim 1 further comprising:

(i) a first starting resistor connected between one of said d.c. bus node and said common node or said reference node and said common node;

(j) a second starting resistor connected between one of said reference node and said control node or said d.c. bus node and said control node;

(k) a driving inductor connected at one end to said common node and operatively connected at the remaining end to said control node;

(l) a resonant inductor connected at one end to said common node, said resonant inductor being mutually coupled to said driving inductor for sensing a voltage across said resonant inductor; and (m) a resonant capacitor serially connected to the remaining end of said resonant inductor, said resonant capacitor connected at the remaining end to said reference node.

4. The inverter circuit of claim 3 further comprising a resistor connected at a location other than said second starting resistor connecting said control node to one of said d.c. bus node and said reference node.

5. The inverter circuit of claim 3 wherein said delay circuit comprises a delay capacitor and a delay resistor serially connected, and wherein said delay circuit further includes said first starting resistor and said second starting resistor.

6. The inverter circuit of claim 5 further comprising:

(n) a d.c. blocking capacitor connected at one end to said reference node;

(o) a gas discharge lamp connected at one end to the remaining end of said d.c. blocking capacitor and at the remaining end to the interconnection of said resonant capacitor and said resonant inductor; and (p) a snubber capacitor connected between said reference node and said common node.

7. The inverter circuit of claim 6 further comprising first and second reverse conducting diodes wherein, said first reverse conducting diode is connected with its anode to said common node and with its cathode connected to said d.c. bus node, and said second reverse conducting diode is connected with its anode to said reference node and with its cathode connected to said common node, wherein said first switch comprises an npn transistor and said second switch comprises a pnp transistor.

8. An inverter circuit for ballasting lamps comprising:

(a) a d.c. bus node;

(b) a reference node;

(c) an inverter control circuit coupled to said d.c. bus node and said reference node for inducing an a.c. load current, said inverter comprising:

(i) first and second inverter switches serially connected between said d.c. bus node and said reference node, being connected together at a common node through which said a.c. load current flows, and each switch having a control terminal connected to a common control node, the voltage between said control node and said common node determining the conduction state of each of said switches;

(ii) a first starting resistor connected between one of said d.c. bus node and said common node or said reference node and said common node;

(iii) a second starting resistor connected between one of said reference node and said control node or said d.c. bus node and said control node;

(iv) a delay circuit connected between said control node and said common node comprising a serially connected delay capacitor and delay resistor, said first starting resistor and said second starting resistor; and (v) a driving inductor connected at one end to said common node and operatively connected at the remaining end to said control node; and (d) a load circuit including:

(i) a resonant inductor connected at one end to said common node, said resonant inductor being mutually coupled to said driving inductor for sensing a voltage across said resonant inductor;

(ii) a serially connected gas discharge lamp and d.c. blocking capacitor connected at one end to the remaining end of said resonant inductor and connected at the remaining end to said reference node; and (iii) a resonant capacitor parallel connected with said serially connected discharge lamp and d.c. blocking capacitor.

9. The inverter circuit of claim 8 further comprising a resistor connected at a location other than said second starting resistor connecting said control node to one of said d.c. bus node and said reference node.

10. The inverter circuit of claim 8 further including a second driving inductor serially connected to said driving inductor between said common node and said control node.

11. The inverter circuit of claim 8 further including a first reverse conducting diode connected between said d.c. bus node and said common node and a second reverse conducting diode connected between said reference node and said common node.

12. The inverter circuit of claim 8 further including a bi-directional voltage clamp connected between said common node and said control node.

13. The inverter circuit of claim 12 wherein said bi-directional voltage clamp comprises back-to-back Zener diodes.

14. The inverter circuit of claim 8 further including a first preferred capacitor connected between said common node and said control node.

15. The inverter circuit of claim 8 further including a second preferred capacitor connected between said d.c. bus node and said reference node.

16. A method of delaying starting of an inverter that ballasts gas discharge lamps, the delaying method comprising:

(a) providing a d.c. bus node;

(b) providing a reference node;

(c) providing an inverter having first and second switches connected serially between said d.c. bus node and said reference node, being connected together at a common node, and each having a respective control terminal connected to a control node;

(d) providing a drive control circuit connected between said common node and said control node having a driving inductor for regenerative control of said first and second switches;

(e) providing a resonant inductor inductively coupled to said driving inductor serially connected to a load circuit comprising a gas discharge lamp, a resonant capacitor and a d.c. blocking capacitor; and (f) delaying activation of said drive control circuit by providing a delay circuit operatively connected across said drive control circuit for delaying oscillation of the inverter for a predetermined period of time.

17. The method of delaying starting of an inverter that ballasts gas discharge lamps according to claim 16 wherein said delay circuit comprises a serially connected delay resistor and delay capacitor connected across said drive control circuit, serially connected at a first end of said delay circuit to a first starting resistor connected between one of said common node and said d.c. bus node or said common node and said reference node, and serially connected at a second end of said delay circuit to a second starting resistor connected between one of said control node and said reference node or said control node and said d.c. bus node.

18. The method of delaying starting of an inverter that ballasts gas discharge lamps according to claim 17 wherein said delay circuit includes a resistor connected at a location other than said second starting resistor connecting said control node to one of said d.c. bus node and said reference node.

19. A multi-inverter system for ballasting lamps comprising:

(a) a common voltage bus conductor;

(b) a common reference conductor;

(c) a plurality of inverter circuits connected between said common voltage bus conductor and said reference conductor, wherein each inverter circuit includes a delay circuit for delaying startup of the respective inverter circuit, and wherein each delay circuit is configured to have a predetermined delay time not equal to the delay time of any other inverter connected to said voltage bus conductor and said reference conductor; and (d) a plurality of lamps, each connected to one of said inverter circuits.

20. The multi-inverter system for ballasting lamps of claim 19, wherein said inverter circuit comprises:

(a) a d.c. bus node connected to a first terminal which is connected to said bus conductor;

(b) a reference node connected to a second terminal which is connected to said reference conductor;

(c) first and second switches, each having a control terminal, serially connected between said d.c. bus node and said reference node;

(d) a control node for interconnecting said control terminals of said first and second switches;

(e) a common node comprising the interconnection of said first and second switches;

(f) a drive control circuit serially connected between said control node and said common node for regenerative control of said first and second switches;

(g) a resonant inductor serially connected to a load circuit between said common node and said reference node;

(h) a first starting resistor connected between one of said bus node and said common node or said reference node and said common node;

(i) a second starting resistor connected between one of said reference node and said control node or said bus node and said control node;

(j) a driving inductor connected at one end to said common node and operatively connected at the remaining end to said control node;

(k) a resonant inductor connected at one end to said common node, said resonant inductor being mutually coupled to said driving inductor for sensing a voltage across said resonant inductor;

(l) a resonant capacitor serially connected to the remaining end of said resonant inductor, said resonant capacitor connected at the remaining end to said reference node; and (m) a delay circuit comprising a serially connected delay capacitor and delay resistor connected between said control node and said common node, said first starting resistor and said second starting resistor.

21. The inverter circuit of claim 20 further comprising a resistor connected at a location other than said second starting resistor connecting said control node to one of said d.c. bus node and said reference node.

22. The multi-inverter system for ballasting lamps of claim 20, wherein said inverter circuit tijrther comprises:

(n) a d.c. blocking capacitor connected at one end to said reference node and at the remaining end to one end of said gas discharge lamp, wherein the remaining end of said gas discharge lamp is connected to the interconnection of said resonant capacitor and said resonant inductor; and (o) a snubber capacitor connected between said reference node and said common node.

23. The multi-inverter system for ballasting lamps of claim 22, wherein said inverter circuit further comprises first and second reverse conducting diodes, and wherein said first reverse conducting diode is connected with its anode to said common node and with its cathode connected to said d.c. bus node, and said second reverse conducting diode is connected with its anode to said reference node and with its cathode connected to said common node;

wherein said first switch comprises an npn transistor and said second switch comprises a pnp transistor.

24. The multi-inverter system for ballasting lamps of claim 19, wherein said inverter circuit comprises:

(a) a first terminal connected to said bus conductor;

(b) a second terminal connected to said reference conductor;

(c) a rectifier circuit configured to receive an a.c. input voltage from said first and second terminals, and configured to provide a rectified d.c. output voltage and a rectifier reference output;

(d) a d.c. bus node connected to receive said rectified d.c. output voltage;

(e) a reference node connected to said rectifier reference output;

(f) first and second switches, each having a control terminal, serially connected between said d.c. bus node and said reference node;

(g) a control node for interconnecting said control terminals of said first and second switches;

(h) a common node comprising the interconnection of said first and second switches;

(i) a drive control circuit serially connected between said control node and said common node for regenerative control of said first and second switches;

(j) a resonant inductor serially connected to a load circuit between said common node and said reference node; and (k) a delay circuit comprising a serially connected delay capacitor and delay resistor connected between said control node and said common node, a first starting resistor connected between one of said bus node and said common node or said reference node and said common node and a second starting resistor connected between one of said reference node and said control node or said reference node and said control node.

25. The inverter circuit of claim 24 further comprising a resistor connected at a location other than said second starting resistor connecting said control node to one of said d.c. bus node and said reference node.

26. A multi-inverter system for ballasting lamps comprising:

(a) an a.c. voltage source;

(b) a power factor controller connected to said voltage source;

(c) a common voltage bus connected to a voltage output of said power factor controller;

(d) a common reference conductor connected to a reference output of said power factor controller;

(e) a plurality of inverter circuits connected between said common voltage bus and said reference conductor, wherein each inverter circuit includes a delay circuit for delaying startup of the respective inverter circuit, and wherein each delay circuit is configured to have a predetermined delay time not equal to the delay time of any other inverter connected to said voltage bus and said reference conductor; and (f) a plurality of lamps, each connected to one of said inverter circuits.

27. The multi-inverter system for ballasting lamps of claim 26, wherein said voltage output of said power factor controller is a d.c. voltage and wherein said inverter circuit further comprises:

(a) a d.c. bus node connected to said bus conductor;

(b) a reference node connected to said reference conductor;

(c) an inverter control circuit coupled to said bus node and said reference node for inducing an a.c. load current, said inverter comprising:

(i) first and second inverter switches serially connected between said bus node and said reference node, being connected together at a common node through which said a.c. load current flows, and each switch having a control node connected to a common control node, the voltage between said control node and said common node determining the conduction state of each of said switches;

(ii) a first starting resistor connected between one of said bus node and said common node or said reference node and said common node;

(iii) a second starting resistor connected between one of said reference node and said control node or said bus node and said control node;

(iv) a delay circuit comprising a delay capacitor serially connected to a delay resistor connected between said control node and said common node, said first starting resistor and said second starting resistor; and (v) a driving inductor connected at one end to said common node and operatively connected at the remaining end to said control node; and (d) a load circuit including:

(i) a resonant inductor connected at one end to said common node, said resonant inductor being mutually coupled to said driving inductor for sensing a voltage across said resonant inductor;

(ii) a d.c. blocking capacitor serially connected to said gas discharge lamp, wherein said serially connected d.c. blocking capacitor and gas discharge lamp are connected at one end to the remaining end of said resonant inductor and connected at the remaining end to said reference node; and (iii) a resonant capacitor parallel connected with said serially connected discharge lamp and d.c. blocking capacitor.

28. The inverter circuit of claim 27 further comprising a resistor connected at a location other than said second starting resistor connecting said control node to one of said d.c. bus node and said reference node.

29. The multi-inverter system for ballasting lamps of claim 27 further including a second driving inductor serially connected to said driving inductor between said common node and said control node.

30. The multi-inverter system for ballasting lamps of claim 27 further including a first reverse conducting diode connected between said bus node and said common node and a second reverse conducting diode connected between said reference node and said common node.

31. The multi-inverter system for ballasting lamps of claim 27 further including a bi-directional voltage clamp connected between said common node and said control node.

32. The multi-inverter system for ballasting lamps of claim 31 wherein said bi-directional voltage clamp comprises back-to-back Zener diodes.

33. The multi-inverter system for ballasting lamps of claim 27 further including a first preferred capacitor connected between said common node and said control node.

34. The multi-inverter system for ballasting lamps of claim 27 further including a second preferred capacitor connected between said bus node and said reference node.

35. The multi-inverter system for ballasting lamps of claim 26, wherein said voltage output of said power factor controller is an a.c. voltage and wherein said inverter circuit further comprises:

(a) a rectifier circuit configured to receive an a.c. input voltage from said common voltage bus and said common reference bus, and configured to provide a rectified d.c. output voltage and a rectifier reference output;

(b) a d.c. bus node connected to receive said rectified d.c. output voltage;

(c) a reference node connected to said rectifier reference output;

(d) an inverter control circuit coupled to said bus node and said reference node for inducing an a.c. load current, said inverter comprising:

(i) first and second inverter switches serially connected between said bus node and said reference node, being connected together at a common node through which said a.c. load current flows, and each switch having a control node connected to a common control node, the voltage between said control node and said common node determining the conduction state of each of said switches;

(ii) a first starting resistor connected between one of said bus node and said common node or said reference node and said common node;

(iii) a second starting resistor connected between one of said reference node and said control node or said bus node and said control node;

(iv) a delay circuit comprising a delay capacitor serially connected to a delay resistor connected between said control node and said common node, said first starting resistor and said second starting resistor; and (v) a driving inductor connected at one end to said common node and operatively connected at the remaining end to said control node; and (e) a load circuit including:

(i) a resonant inductor connected at one end to said common node, said resonant inductor being mutually coupled to said driving inductor for sensing a voltage across said resonant inductor;

(ii) a d.c. blocking capacitor serially connected to said gas discharge lamp, wherein said serially connected d.c. blocking capacitor and gas discharge lamp are connected at one end to the remaining end of said resonant inductor and connected at the remaining end to said reference node; and (iii) a resonant capacitor parallel connected with said serially connected discharge lamp and d.c. blocking capacitor.

36. The multi-inverter system for ballasting lamps of claim 35 further including:

(f) a second driving inductor serially connected to said driving inductor between said common node and said control node;

(g) a first reverse conducting diode connected between said bus node and said common node;

(h) a second reverse conducting diode connected between said reference node and said common node;

(i) a bi-directional voltage clamp connected between said common node and said control node;

(j) a first preferred capacitor connected between said common node and said control node; and (k) a second preferred capacitor connected between said bus node and said reference node.

37. A method of sequencing the starting of a plurality of inverters that ballast lamps, the sequencing method comprising:

(a) providing a common voltage bus conductor;

(b) providing a reference conductor;

(c) providing a plurality of inverter circuits connected between said common voltage bus conductor and said reference conductor, wherein each inverter circuit includes:

(i) a bus node connected to said bus conductor;

(ii) a reference node connected to said reference conductor;

(iii) serially connected first and second switches connected serially between said bus node and said reference node, being connected together at a common node, and each having a respective control terminal connected to a control node;

(iv) a drive control circuit having a driving inductor for regenerative control of said first and second switches;

(v) a resonant inductor inductively coupled to said driving inductor serially connected to a load circuit comprising a gas discharge lamp, a resonant capacitor and a d.c. blocking capacitor; and (vi) a delay circuit operatively connected across said drive control circuit; and (d) configuring each of said delay circuits to have a startup delay time not equal to any of the remaining delay circuits.

38. The method of sequencing the starting of a plurality of inverters that ballast lamps according to claim 37 wherein said delay circuit comprises a serially connected delay resistor and delay capacitor connected across said drive control circuit, serially connected at a first end of said delay circuit to a first starting resistor connected between one of said common node and said bus node or said common node and said reference node, and serially connected at a second end of said delay circuit to a second starting resistor connected between one of said control node and said reference node or said control node and said bus node.

* * * * *